US006276240B1

(12) United States Patent
Blacklock

(10) Patent No.: US 6,276,240 B1
(45) Date of Patent: Aug. 21, 2001

(54) MULTI-SIZED, REVERSIBLE RATCHETING ACTION OPEN END WRENCH

(76) Inventor: Gordon D. Blacklock, 14116 Grand NE., Albuquerque, NM (US) 87123

( * ) Notice: Subject to any disclaimer, the term of this patent is extended or adjusted under 35 U.S.C. 154(b) by 0 days.

(21) Appl. No.: 09/436,370

(22) Filed: Nov. 9, 1999

Related U.S. Application Data

(60) Provisional application No. 60/107,703, filed on Nov. 9, 1998.

(51) Int. Cl.[7] ..... B25B 13/02
(52) U.S. Cl. ..... 81/119; 81/186
(58) Field of Search ..... 81/119, 125.1, 81/186

(56) References Cited

U.S. PATENT DOCUMENTS

| | | | | |
|---|---|---|---|---|
| 37,920 | * | 3/1863 | Penny | 81/119 |
| D. 357,618 | | 4/1995 | Macor . | |
| 999,968 | * | 8/1911 | Denham | 81/125.1 |
| 1,479,772 | | 1/1924 | Cook . | |
| 1,954,141 | * | 4/1934 | Miquelon | 81/119 |
| 2,334,069 | * | 11/1943 | Collins et al. | 81/119 |
| 2,592,781 | | 4/1952 | Yavner . | |
| 2,671,368 | | 3/1954 | Diebold . | |
| 3,252,359 | | 5/1966 | Bodkin . | |
| 3,745,859 | * | 7/1973 | Evans et al. | 81/119 |
| 3,881,377 | | 5/1975 | Evans et al. . | |
| 3,955,450 | | 5/1976 | Evans . | |
| 4,440,047 | | 4/1984 | Robbins . | |
| 4,787,275 | | 11/1988 | Colvin . | |
| 4,838,132 | | 6/1989 | Pyles . | |
| 5,136,902 | | 8/1992 | Ma . | |
| 5,415,064 | | 5/1995 | Chang . | |
| 5,533,428 | | 7/1996 | Pradelski . | |
| 5,551,322 | * | 9/1996 | Mikic et al. | 81/186 |
| 5,671,644 | * | 9/1997 | Anderson | 81/119 |

* cited by examiner

*Primary Examiner*—Eileen P. Morgan
*Assistant Examiner*—Joni B. Danganan
(74) *Attorney, Agent, or Firm*—Siemens Patent Services LC

(57) ABSTRACT

An open end wrench having two heads each of which provides ratchet action, each of which accepts fasteners of different nominal sizes, and each of which imposes torque on the fastener only on flat facets and not at apices between adjacent facets. Each head has a first jaw bearing a convex interior surface facing the interior surface of a second jaw. The second jaw has plural pairs of intersecting facets where, in a first embodiment, the included angle formed between intersecting facets is greater than ninety degrees and less than one hundred twenty degrees. In another embodiment, the included angle is greater than seventy degrees and less than ninety degrees. Each pair of intersecting facets accommodates a polygonal fastener of one nominal size. The two embodiments are usable with hexagonal and square headed fasteners, respectively.

11 Claims, 4 Drawing Sheets

MULTI-SIZED, REVERSIBLE RATCHETING ACTION OPEN END WRENCH

REFERENCE TO RELATED APPLICATION

This application is related to Provisional Application No. 60/107,703, filed Nov. 9, 1998.

BACKGROUND OF THE INVENTION

1. Field of the Invention

The present invention relates to hand tools, and more particularly to wrenches of the type known as open end. The novel wrench can drive many different sized fasteners by a single tool with ratcheting action, and can do so in two opposite directions. The present invention finds application in any field wherein hexagonal or similar headed fasteners are employed to assemble machines, furnishings, and objects of all types.

2. Description of the Prior Art

Hand wrenches for tightening and slackening threaded fasteners having polygonal heads are old and well known. These wrenches have made the use of such fasteners quite practical, since they readily enable necessary force to tighten and slacken fasteners. Varieties of wrenches include two headed open end wrenches typically formed from a single piece of steel. Open end wrenches have the advantage of lacking relatively movable parts. However, certain minor yet annoying deficiencies in the use of wrenches remain. One deficiency is that each head of most wrenches is configured to engage only one size fastener head. Since heads vary in size, usually in proportion to shank size, mechanics and craftsmen are usually obliged to have available an extensive plurality of wrenches to assure possessing a wrench suitable for each fastener head size frequently encountered.

A second problem frequently encountered in utilizing hand wrenches is their propensity to deform corners or apices formed at the juncture of two flat facets of the polygonal fastener head or nut. Frequently, deformation takes the form of rounding of the usually sharp line of intersection of two flat facets. In some cases, plastic deformation results in a distortion of a hexagonal or other polygonal configuration. In this case, an originally flat facet may bulge to the extent that the head of the fastener does not conform to a tool having a polygonal opening configured to receive the head of the fastener.

Box and ratchet wrenches apply a significant portion of force at the apices of the fastener head. Therefore, likelihood of rounding and deformation is significant. Simultaneously, if a fastener head has been deformed, a wrench may lose its ability to turn that fastener. The fastener may become useless, and if deformed in the installed, tightened condition, may prevent ready disassembly of the article to which it is fastened.

Another aspect in which hand wrenches are deficient is that because many fasteners require a large number of rotations of their threaded shanks to fully install and remove, an open end wrench is frequently removed from engagement with the fastener head and replaced thereon in an advantageous position to turn the fastener. The effort of frequently removing and replacing an open end wrench is laborious in that it noticeably increases the amount of time to install and remove fasteners compared to the use of ratchet action wrenches which do not need to be removed from engagement with the head.

The prior art has sought to improve hand wrenches in various ways. U.S. Pat. No. 2,671,368, issued to Fritz Diebold on Mar. 9, 1954, describes a wrench which can engage a plurality of fastener sizes, albeit only one at a time. This alleviates the necessity of possessing many wrenches. The wrench of Diebold also imposes force on flat facets of the fastener head between the apices thereof, thereby reducing likelihood of damage to fastener heads. However, the wrench of Diebold does not provide ratchet action, as can the present invention.

U.S. Pat. No. 1,479,772, issued to Walter Herbert Cook on Jan. 1, 1924, describes an open end wrench which provides ratcheting action, and can engage selectively any one of several nominal sizes with one wrench head. However, the wrench of Cook cannot apply torque to a polygonal fastener head only at the flat surfaces, while sparing the apices of the head from potentially deforming force.

U.S. Pat. No. 999,968, issued to Edwin A. Denham on Aug. 11, 1911, illustrates a wrench which accepts plural fastener sizes, which provides ratcheting action, and which applies torque to the flat facets of polygonal heads of fasteners. However, cooperation between the wrench head of Denham and a polygonal fastener is such that the fastener fits perfectly into the wrench, as illustrated in FIGS. 5, 6, and 7 in Denham. By contrast, adjacent flat surfaces of the novel wrench are arranged at an angle which prevents the facets of the wrench from abutting in flush contact with the wrench. A space or gap is created which accommodates potential deformation of the fastener in the present invention. This feature is absent in Denham.

U.S. Pat. Nos. 446,324 and 463,137, issued to Daniel H. Carpenter on Feb. 10, 1891, and Nov. 17, 1891, respectively, illustrate wrenches which receive plural fasteners, which ratchet, and which apply torque to facets of the fastener. However, unlike the present invention, there is no abutment of flat surfaces of both the wrench and of the fastener. Also, the wrenches of Carpenter do not provide the amount of accommodation of deformation of the fastener, as seen in the present invention.

None of the above inventions and patents, taken either singly or in combination, is seen to describe the instant invention as claimed.

SUMMARY OF THE INVENTION

The present invention sets forth an open end wrench which can engage plural fastener heads with one wrench head, which offers ratchet action, and which avoids rounding the apices of polygonal fastener heads. The novel wrench presents a generally conventional appearance upon first glance, having an elongate flat shank terminating at each end in an open head having two jaws. Configuration of the jaws, however, departs from prior art practice in that the features confer three characteristics none of which operates to the exclusion of the others.

One characteristic is that the interior surface of one jaw imposes torque to the fastener in a manner avoiding rounding or otherwise deforming the apices of the fastener head. One jaw of each head is stepped and the opposing jaw of the same head is specially curved to engage the fastener head in a manner assuring that torque is imposed mostly on a flat facet of the fastener head. Each step formed in the stepped jaw, taken with the interior surface of the opposing jaw, corresponds to one nominal fastener head size. Configuration of the steps and of the opposing jaw is such that torque is imparted to the flat facets of a polygonal fastener head, with little if any being imposed on the apices.

Furthermore, angles of the steps are such that only one flat facet of the head of the fastener is engaged in surface contact. This feature accommodates polygonal heads which have been deformed so that bulges are formed near the apices. The novel wrench is thus usable not only with new fasteners in perfect condition, but also with old fasteners which have suffered distortion as a result of abuse.

A second characteristic is that the steps are so configured that turning the wrench in one direction rotates the fastener, and turning the wrench in the opposite direction causes slippage between the wrench and the fastener head. This motion is, in effect, ratcheting action between the wrench and the fastener, although the wrench is slightly displaced relative to the rotational axis of the fastener when it slips. For purposes of tightening and slackening fasteners, this minor degree of displacement is not objectionable and indeed may possibly not even be noticed by the user.

A third characteristic is that each wrench head has sufficient steps formed therein that the wrench head accepts more than one nominal fastener size. In summary, any one novel wrench fits many nominal fastener sizes, ratchets relative to the driven fastener, and avoids deforming or rounding the fastener head.

Accordingly, it is one object of the invention to provide an open end wrench which fits a plurality of nominal fastener sizes.

It is another object of the invention that the novel wrench ratchet relative to a driven fastener, so that it need not be manually disengaged from the fastener being driven.

It is a further object of the invention that the novel wrench avoid deforming and rounding apices of the head of a fastener being driven.

Still another object of the invention is to accommodate deformed polygonal heads of fasteners.

An additional object of the invention is to combine the three above functions in one wrench.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
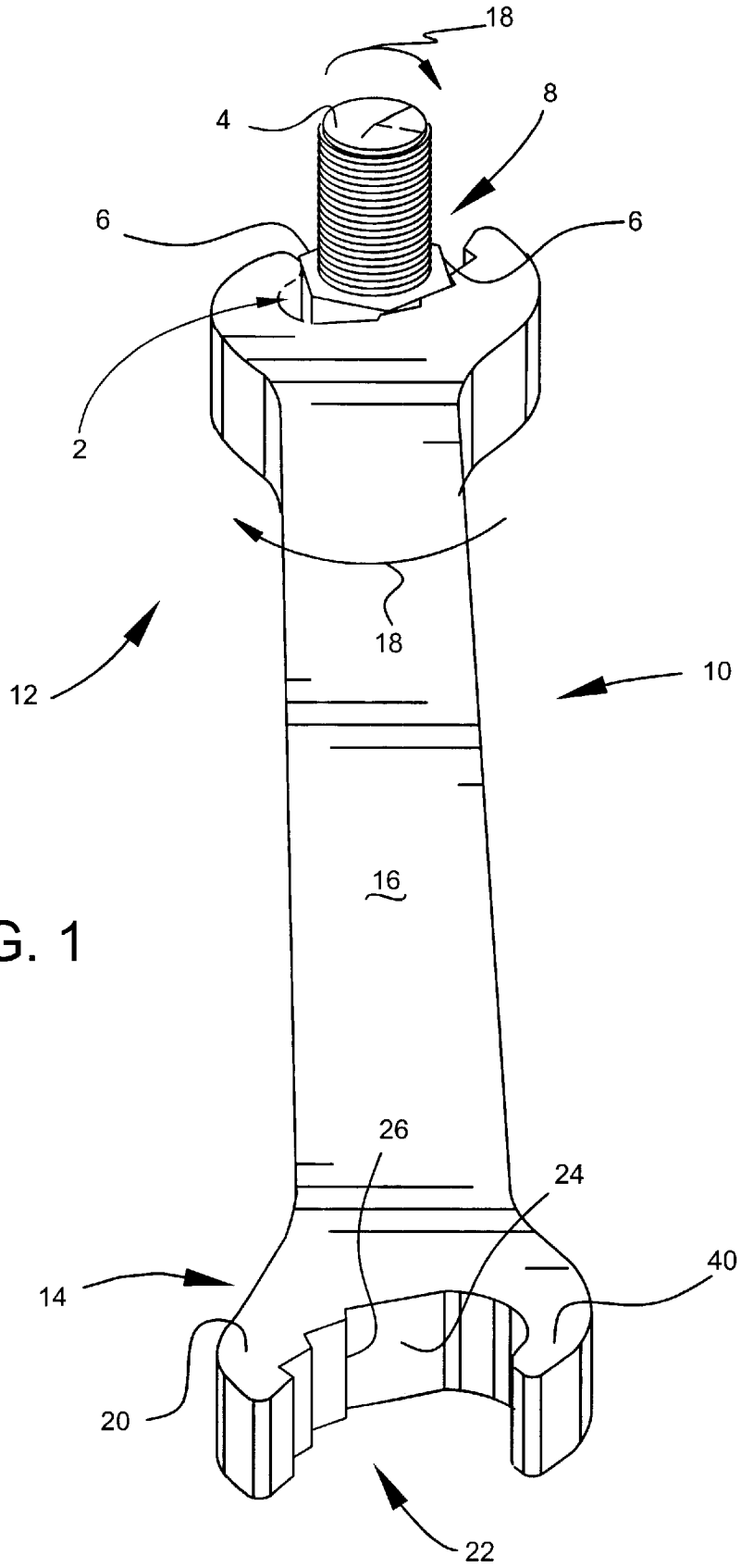
FIG. 1 is an environmental, perspective view of a wrench embodying the invention.

FIG. 1 of the drawings shows a wrench 10 for imposing torque to regular polygonal heads of fasteners such as nut 2 threaded onto shaft 4. For the purposes of this invention, nut 2 is of a frequently employed type having flat facets 6 and an exterior angle 8 formed at the intersection of each two adjacent facets 6 of the polygon. Wrench 10 includes a first driving head 12, a second driving head 14, and an elongate shank 16 to which heads 12, 14 are solidly fixed. Wrench 10 is turned in the direction indicated by arrows 18 to drive nut 2. If turned in the opposite direction, wrench 10 will disengage from driving relationship with nut 2, and will rotate ineffectually. This characteristic assures that a form of ratcheting action ensues. Wrench 10 may therefore always be urged into engagement with nut 2 by hand so that tightening and untightening may be performed expeditiously. It is not necessary to remove wrench 10 from engagement with a fastener in order to proceed with turning the fastener.

Figure 2:
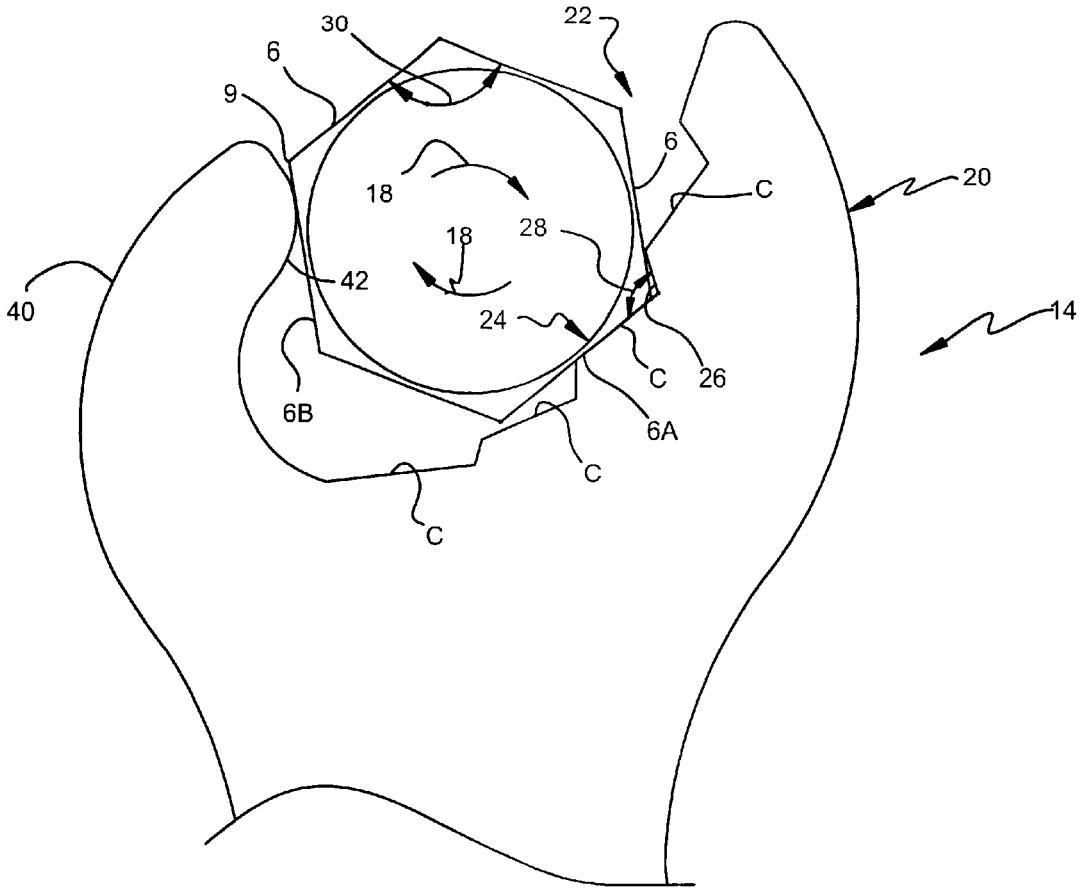
FIG. 2 is a top plan view of a wrench embodying the invention.
Figure 3:
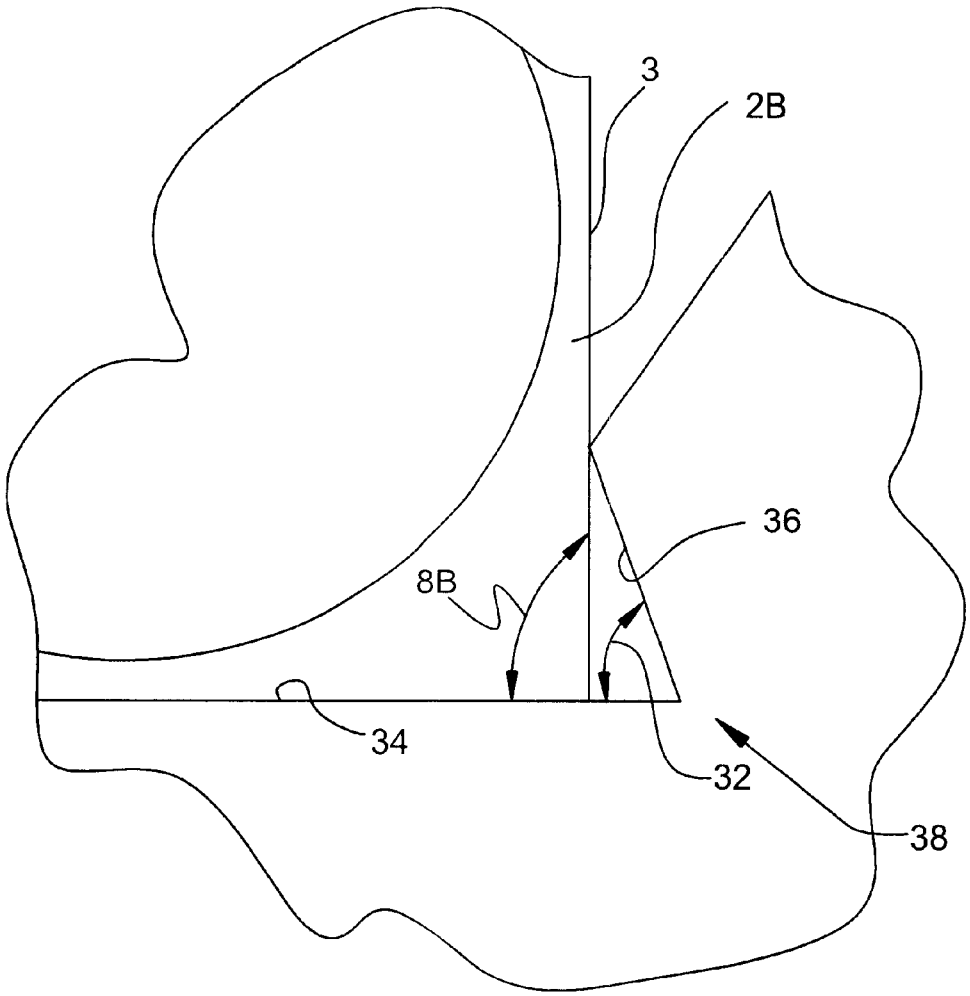
FIG. 3 is an environmental, detail view showing cooperation between a square nut and an embodiment of the invention adapted to drive square headed fasteners.

Turning now to FIG. 2, driving head 14 has a first jaw 20 bearing a first engagement surface 22 bearing a plurality of straight, flat facets arranged in angled pairs. Each pair of facets includes a supporting facet 24 and a stopping facet 26. An included angle 28 is disposed between supporting facet 24 and stopping facet 26. Magnitude of included angle 28 is less than the exterior angle 30 of the fastener formed between at the apex between two adjacent facets 6. For embodiments of wrench 10 intended to turn hexagonal fasteners, such as nut 2, angle 28 is of magnitude greater than ninety degrees and less than one hundred twenty degrees. For embodiments of wrench 10 intended to turn square fasteners, as shown in FIG. 3, interior angle 32 formed between supporting facet 34 and stopping facet 36 is greater than seventy degrees and less than ninety degrees. This assures that for a nut 2B having an exterior angle 8B of ninety degrees, a small space or gap 38 is formed. Gap 38 accommodates a bulge (not shown) which might exist if a nut being turned has been deformed.

Returning to FIG. 2, driving head 14 has a second jaw 40 which is opposed to jaw 20. Jaw 40 bears a convex curved second engagement surface 42 facing first engagement surface 22 of first jaw 20. Second engagement surface 42 is dimensioned and configured to avoid imposing force on an apex 9 of the polygonal head of the fastener when a facet 6A of the polygonal head of the fastener flushly abuts supporting facet 24 of first engagement surface 22. This is due to contact of surface 42 along facet 6B, well away from apex 9.

The center point C of each supporting facet (such as facet 24) of first jaw 20 is spaced apart from second engagement surface 42 of second jaw 40 of driving head 14 by a magnitude different from those spacing apart the center points of every other supporting facet of first jaw 20 from second engagement surface 42 of second jaw 40. The same relationships hold for the engagement surfaces of driving head 12. Moreover, distances between the supporting facets of head 12 and the opposed engagement surface of head 12 are different from those between the supporting facets of head 14 and the opposed engagement surface 42 of driving head 14. This assures that head 12 will receive and cooperate with certain nominal sizes of fasteners, while head 14 will receive and cooperate with different nominal sizes of fasteners.

Figure 4:
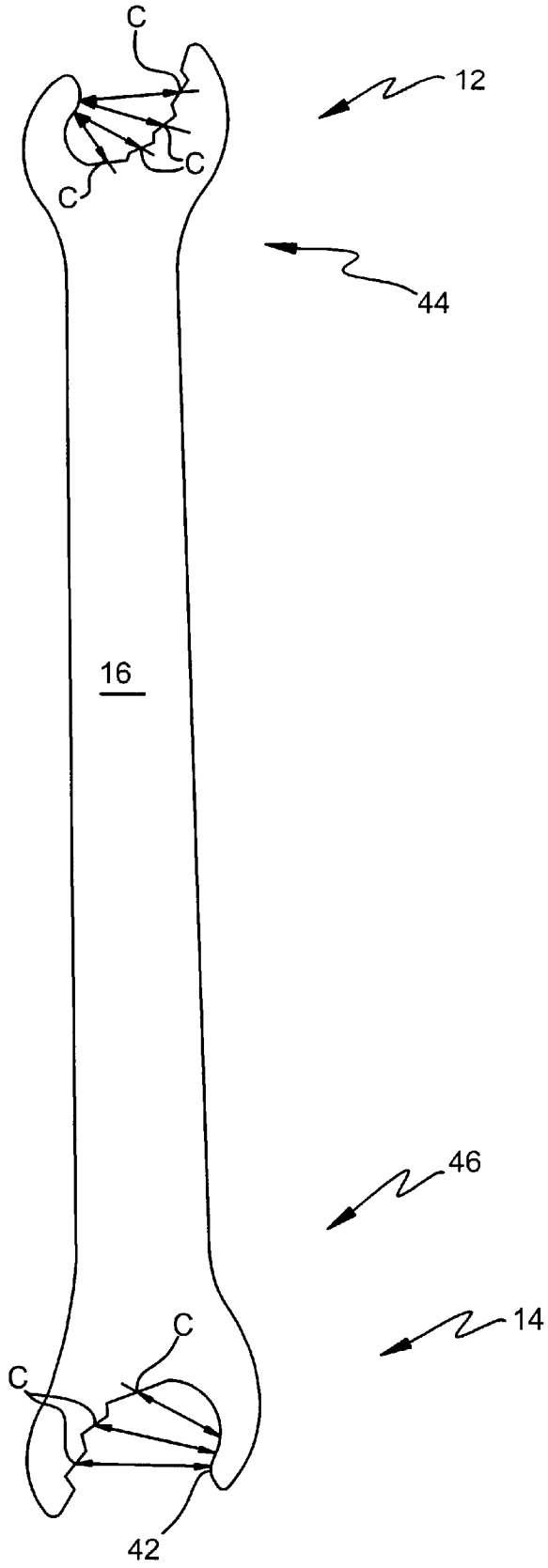
FIG. 4 is an environmental, detail view of a wrench embodying the invention, showing lines an areas of contact between the novel wrench and a representative driven fastener.

FIG. 4 shows a preferred embodiment of the invention, wherein wrench 10 is a double headed, open end wrench wherein head 12 is fixed to elongate shank 16 at a first end 44 thereof, and head 14 is fixed to shank 16 at a second end 46 thereof. It will be seen in the embodiment of FIG. 4 that head 12 is configured to drive four nominal sizes of hexagonal fasteners, and head 14 is configured to drive three nominal sizes. Shank 16 serves as a handle and also enables a user to employ leverage to impose force.

The present invention may be varied from the embodiment presented above. For example, the invention may be utilized in a single headed wrench (not shown). Alternatively, a driving head equivalent to head 12 or 14 may be formed as a crow's foot socket (not shown), that being a wrench having a working head similar to head 12 or 14, but having a square or otherwise configured hole so that the head may be operated as in the manner of a replaceable socket on a socket driver having a square, hexagonal, or otherwise configured drive shaft, obviously, that portion of a device driven by the invention may be a shank or shaft, and not merely an enlarged head typical of a nut or bolt. Also, the number, dimensions, and configurations of the fastener receiving portions of the invention may able to accommodate different driven fasteners.

It is to be understood that the present invention is not limited to the embodiments described above, but encompasses any and all embodiments within the scope of the following claims.

I claim:

1. A wrench for imposing torque to regular polygonal heads of fasteners of the type wherein each head of a fastener has an exterior angle formed at the intersection of each two adjacent facets of the polygon, said wrench having a first driving head including:

a first jaw bearing a first engagement surface bearing a plurality of straight, flat facets arranged in angled pairs, wherein each said pair of facets includes a supporting facet, a stopping facet, and an included angle disposed between said supporting facet and said stopping facet, each of said pairs of facets being adapted to receive a different size fastener head; and an opposed second jaw bearing a convex curved second engagement surface facing said first engagement surface of said first jaw, such that said second engagement surface is dimensioned and configured to avoid imposing force on an apex of the polygonal head of the fastener when a facet of the polygonal head of the fastener flushly abuts said supporting facet of said first engagement surface of said first jaw, wherein the center point of each said supporting facet of said first jaw is spaced apart from said first engagement surface of said second jaw by a magnitude different from those spacing apart the center point of every other supporting facet of said first jaw from said second engagement surface of said second jaw, and wherein every said included angle is of magnitude less than that of the exterior angle of the head of the fastener.

2. The wrench according to claim 1, further including an elongate shank having a first end and a second end, wherein said first driving head is fixed to said elongate shank at said first end of said shank.

3. The wrench according to claim 2, further including a second driving head for imposing torque to regular polygonal heads of fasteners, wherein said second driving head is fixed to said second end of said elongate shank, said second driving head including a third jaw bearing a first engagement surface bearing a plurality of straight, flat facets arranged in angled pairs, wherein each said pair of facets includes a supporting facet, a stopping facet, and an included angle disposed between said supporting facet and said stopping facet, and an opposed fourth jaw bearing a curved second engagement surface facing said first engagement surface of said third jaw, such that said second engagement surface is dimensioned and configured to avoid imposing force on an apex of the polygonal head of the fastener when a facet of the polygonal head of the fastener flushly abuts a said supporting facet of said first engagement surface of said third jaw, and wherein the center point of each said supporting facet of said third jaw is spaced apart from said first engagement surface of said fourth jaw by a magnitude different from those spacing apart the center point of every other supporting facet of said third jaw from said second engagement surface of said fourth jaw, and also different from those spacing apart the center point of ever supporting facet of said first jaw from said second engagement surface of said second jaw, whereby said first driving head serves fasteners of nominal dimensions different from fasteners served by said second driving head, and wherein said included angle is of magnitude less than that of the exterior angle of the regular polygonal head of the fastener.

4. The wrench according to claim 1, wherein said included angle is of magnitude greater than ninety degrees and less than one hundred twenty degrees.

5. The wrench according to claim 1, wherein said included angle is of magnitude greater than seventy degrees and less than ninety degrees.

6. A wrench for imposing torque to regular polygonal fastener heads and nuts, wherein each such head has an exterior angle formed at the intersection of each pair of adjacent flats of the polygon, said wrench having a driving head including:

a first jaw having a multi-faceted engagement surface comprised of a plurality of straight, flat facets arranged in angled pairs, wherein each said pair of facets includes a supporting facet and a stopping facet, the supporting and stopping facets of each pair being joined at an included angle, each of said pairs of facets being adapted to receive a different size fastener head; and an opposed jaw bearing a convex curved engagement surface facing said multi-faceted engagement surface, such that said curved engagement surface is dimensioned and configured to avoid imposing force on an intersection of such flats when a flat of one such fastener flushly abuts a said supporting facet of said multi-faceted engagement surface of said first jaw, wherein a center point of each said supporting facet is spaced apart from said curved engagement surface a different spacing than the spacing of a center point of every other supporting facet from said curved engagement surface, and wherein every said included angle is of magnitude less than that of the exterior angle between adjacent flats of any such fastener of a size the wrench is intended to torque.

7. The wrench according to claim 6, further including an elongate shank, wherein said driving head is fixed to an end of said shank.

8. The wrench according to claim 7, further including a second driving head for imposing torque to regular polygonal heads of fasteners, wherein said second driving head is fixed to another end of said elongate shank, said second driving head including a third jaw having a multi-faceted engagement surface comprised of a plurality of straight, flat facets arranged in angled pairs, each said pair of facets including a supporting facet and stopping facet, the supporting and stopping facets of each said pair being joined at an included angle, and an opposed fourth jaw bearing a curved engagement surface facing said multi-faceted engagement surface of said third jaw, said second engagement surface being dimensioned and configured to avoid imposing force on an intersection of such fastener flats when a flat of one such fastener flushly abuts a said supporting facet of said first engagement surface of said third jaw, and wherein a center point of each said supporting facet of said third jaw is spaced apart from said curved engagement surface of said fourth jaw a different spacing than the spacing of a center point of every other supporting facet of said third jaw from said curved engagement surface of said fourth jaw, and also different from the spacing of the center point of every supporting facet of said first jaw from said curved engagement surface of said second jaw, whereby said first driving head serves fasteners of dimensions different from fasteners served by said second driving head, and wherein each said included angle is of magnitude less than that of an exterior angle between adjacent flats of a fastener of a size the wrench is intended to torque.

9. The wrench according to claim 6, wherein said included angle is of magnitude greater than ninety degrees and less than one hundred twenty degrees.

10. The wrench according to claim 6, wherein said included angle is of magnitude greater than seventy degrees and less than ninety degrees.

11. An open ended wrench for torquing polygonal fastener heads and nuts of a range of sizes comprising:

(a) a handle:

(b) a spaced pair of jaws secured to and projecting from the handle;

(c) one of the jaws including a plurality of facet pairs, each of said pairs of facets being adapted to receive a different size fastener head (d) the other of the jaws including a curved fastener engagement surface spaced from and arranged to cooperate with the facet pairs;

(e) each facet pair including a supporting facet configured for surface engagement with a flat of a fastener, the curved surface being positioned to establish a generally centered line engagement with a fastener flat opposite a surface engaged flat;

(f) the spacing between each supporting facet and the curved surface being different than the spacing between each other supporting facet and the curved surface whereby the wrench is operable with fasteners of a plurality of sizes; and (g) the facets of each and every pair being joined at an included angle smaller than an angle between adjacent flats of a fastener of a size the pair is intended to torque whereby to provide a wrench adapted to torque both new and worn polygonal fastener heads and nuts with a ratchet action.

* * * * *